US005097782A

United States Patent [19]

Baudet et al.

[11] Patent Number: 5,097,782

[45] Date of Patent: Mar. 24, 1992

[54] SAIL WITH REINFORCED BATTEN POCKET ENDS

[75] Inventors: Jean-Pierre Baudet, Lausanne, Switzerland; William A. Bergantz, Trumbull, Conn.

[73] Assignee: North Sails Group, Inc., Milford, Conn.

[21] Appl. No.: 615,972

[22] Filed: Nov. 20, 1990

[51] Int. Cl.[5] ..... B63H 9/06

[52] U.S. Cl. ..... 114/103

[58] Field of Search ..... 114/102, 103, 39.1, 114/39.2

[56] References Cited

U.S. PATENT DOCUMENTS 4,444,822 4/1984 Doyle ..... 114/103

4,602,585 7/1986 Hackney ..... 114/103

*Primary Examiner*—Sherman Basinger

*Attorney, Agent, or Firm*—Juettner Pyle & Lloyd

[57] ABSTRACT

A reinforcing patch is secured to a sail to support the inner ends of battens carried in pockets on the sail. The patch is a laminate having yarns radiating in an omnidirectional pattern from the end of the batten pocket and batten.

8 Claims, 1 Drawing Sheet

SAIL WITH REINFORCED BATTEN POCKET ENDS

BACKGROUND OF THE INVENTION

This invention relates to sails or other pliant lifting surfaces and more particularly to sails which carry battens.

Battens are used in sails to provide support for the sail beyond that which is provided by the rigging. The battens are typically elongate and flat and flexible in one direction, and are made of wood or composite materials, such as fiber reinforced plastics. The battens are inserted into vertically spaced elongated pockets which extend generally horizontally or at a slight downward angle across the sail body from the rear edge or leech of the sail toward the luff. The batten pockets are normally constructed from strips of fabrics, with the edges of the strip sewn to the body to form a pocket which is open at the leech to enable insertion of the batten. Battens are employed, for example, in mainsails to provide support for the roach, or an enlarged region adjacent the leech.

Except in the case of a full batten sail, wherein the batten extends from luff to leach, a conventional batten and it associated pocket extend from the leech across only a portion of the sail and terminate at an inner end at a location in the body of the sail. It is known that the region of the sail adjacent to the inner end of the batten is subject to heavy stresses and shocks. The battens are relatively heavy and inflexible in comparison to the sail fabric and may transmit shocks or high stresses to the fabric when the sail is flogging, especially at the interior ends of the battens. This may cause undesirable excessive stretch in the fabric or premature failure of the sail.

In order to accommodate stresses at the batten ends, it is known to apply reinforcing strips of cloth or fabric at the inner ends of the batten pocket. For example, two strips of cloth may be sewn in the form of an "X", with the center being located at the end of the batten pocket. Each strip must be sewn on separately, which is a labor intensive operation, especially with larger sails, and reinforcement in all directions is not provided. It is also known to apply reinforcing patches of fabric at the corners and other attachment points of a sail.

SUMMARY OF THE INVENTION

In accordance with the present invention, a reinforcing patch is provided for the inner end of the batten pocket in a sail. The patch is a laminate having a pair of outer layers with a central layer of reinforcing yarns, with the layers being secured together with a cured adhesive. The yarns radiate from a central portion or area of the patch. The patch is first applied to the sail using a suitable adhesive, and the batten pocket is then secured to the sail, with the inner end of the pocket terminating at or near the centroid of the patch. The patch serves to distribute shocks and stresses generated by the batten evenly to the body of the sail to minimize wear and damage to the sail fabric near the batten ends. Conversely, the radiating yarns serve to reinforce the sail fabric in all directions from the point or zone where major shock loads are transferred from the batten into the sail fabric. The concentration of yarns is the greatest in the immediate zone of the batten end, providing maximum and efficient support without the addition of unnecessary weight.

THE DRAWINGS

DESCRIPTION OF THE PREFERRED EMBODIMENTS

Figure 1:
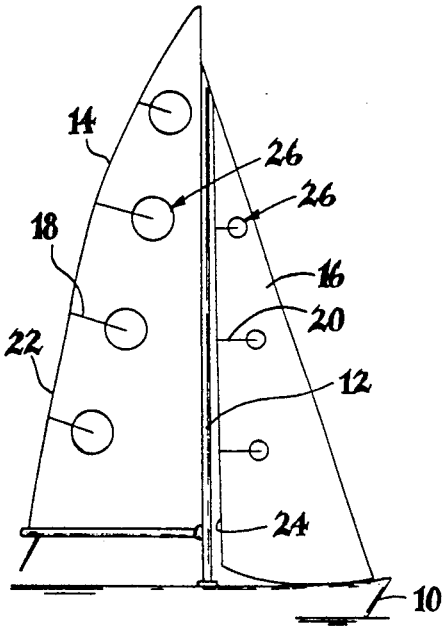
FIG. 1 is a plan view of a sail with the batten pocket end being reinforced with a patch in accordance with the present invention.

FIG. 1 illustrates a sailing vessel having a hull 10 and an upright mast 12 which supports a mainsail 14 and a jib 16 in a conventional fashion. In the embodiment shown, both the main 14 and jib 16 carry a plurality of battens, which are generally indicated at 18 and 20, respectively. The battens 18 and 20 extend inwardly from a rear edge or leech 22 and 24 of each sail and terminate in an intermediate portion of the body of the sail. The use of battens and their incorporation into sails for reinforcing purposes are well known to those skilled in the art and need not be described herein in detail.

Figure 2:
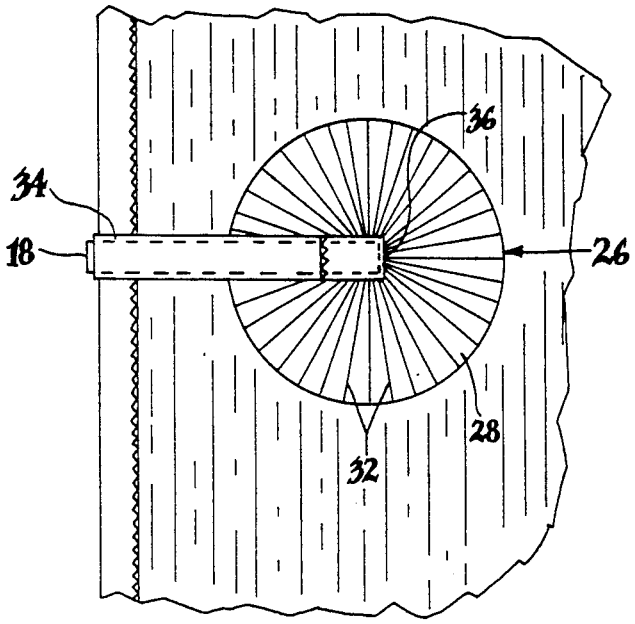
FIG. 2 is a detailed view of a portion of the sail shown in FIG. 1.
Figure 3:
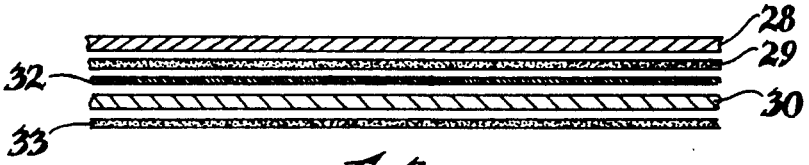
FIG. 3 is an enlarged schematic sectional view of the patch of the present invention.

As shown in FIGS. 1 through 3, and in accordance with the present invention, the inner ends of the battens 18 and 20 are reinforced by a patch 26 of particular construction, which is separately made and affixed to the sail body at or near the inner end of the battens.

As shown in FIGS. 2 and 3, the patch 26 is of laminated construction and comprises a pair of outer layers 28 and 30 of flexible sheet material and an inner layer of reinforcing or load distribution yarns 32. The yarns 32 are arranged such that they radiate from a central zone in an inner or central region of the patch 26, preferably in an omnidirectional pattern.

While the shape of the patch 26 as shown in the preferred embodiment is circular, with the yarns 32 radiating substantially uniformly from the center, it will be obvious that many other shapes could be employed, including oval and multisided shapes such as polygons. In the case of jib battens, the average of diameter of the patch will be approximately equal to the length of the batten. In the case of mainsails, the average diameter of the patch will be in the order of from about 15% to about 60% of the length of the batten.

The outer layers 28 and 30 of the patch 26 may comprise sheets of any fabric or film which is conventionally used in the manufacture of sails. For ease of construction and durability, impervious films are preferred, such as ones made of polyester, nylon, Tedlar, vinyl and the like and having a thickness in the order of 0.5 to about 3 mils., depending on the size and weight of the sail. The yarns 32 are preferably made of relatively non-extensible materials such as polyester, Kevlar, carbon, Spectra and the like in the order of about 400 to about 5,000 denier, again, depending on the size and weight of the sail.

The patch 26 may be constructed by applying the yarns onto the surface of one outer layer in a radiating pattern using guides such as pegs or pins which are spaced around the outer periphery of the area of the patch. The number and spacing of the yarns will vary, depending on the overall size of the patch and the conditions of intended use of the sail. A curable adhesive 29 is then applied, such as a thermoplastic or solvent based, and the other outer layer is applied. The adhesive is then cured, and the patch may be trimmed or cut into the desired shape.

Following preparation of the patches, the sail is marked to show placement of the batten pockets and the patches are applied such that the center portions thereof coincide with the end of the batten pocket. The patches are then secured to the body of the sail at the approximate locations by suitable means, such as sewing, but preferably the patches are applied by a suitable adhesive, such as a heat curable or pressure sensitive adhesive, applied as a coating 33 to one of the outer layers 30 of the patch.

The batten pocket 34, comprising an elongated rectangular strip of cloth, may be applied to the sail by sewing the strip around the margins to the sail body as shown in a conventional manner. When applied, it will be seen that the inner end portion of the pocket overlaps and covers a portion of the patch, with the end 36 of the pocket terminating in the central portion of the patch 26, or a portion from which the yarns radiate outwardly.

It may be seen that the patch of the present invention serves to uniformly distribute and dissipate shocks or forces from the end of the batten, irrespective of the direction of the force, since the batten end is supported substantially in all direction by the radial yarns.

While the patch of the present invention is particularly suitable for use in sails, it may also be employed in any pliant lifting surface having flexible reinforcing members, such as battens, which terminate in an intermediate portion of the surface.

We claim:

1. In conjunction with a pliant lifting member driven by the wind and having outer edges and a body, and wherein a reinforcing batten extends in a pocket on the body of said member and terminates in an inner end at a location in an intermediate portion of the body, the improvement comprising a patch secured to the surface of said body at said location, said patch comprising a plurality of individual reinforcing yarns radiating outwardly from said location and said inner end.

2. In conjunction with a sail having a pliant body and a reinforcing batten therein extending in a pocket from an edge of the sail and terminating in the body thereof at a particular location, the improvement comprising a patch affixed to the body of the sail at said location, said patch comprising a laminate of flexible sheet material, said laminate comprising an inner layer of a plurality of individual reinforcing yarns radiating from said location outwardly whereby to evenly distribute shocks from the end of the batten into the body of the sail.

3. The improvement of claim 2 wherein the patch comprises a pair of outer layers of flexible sheet material.

4. The improvement of claim 3 wherein said sheets comprise films.

5. The improvement of claim 3 additionally comprising a cured adhesive between said outer layers.

6. The improvement of claim 2 wherein said yarns radiate from said location in an omnidirectional fashion.

7. The improvement of claim 2 wherein said patch is affixed to said sail with an adhesive.

8. The improvement of claim 2 wherein said patch is affixed to the sail between the batten pocket and the sail body.

* * * * *